US009812059B2

(12) United States Patent
Li et al.

(10) Patent No.: US 9,812,059 B2
(45) Date of Patent: Nov. 7, 2017

(54) DISPLAY DEVICE, METHOD FOR TRANSMITTING DATA PACKET, AND LED SYSTEM

(71) Applicant: SCT TECHNOLOGY, LTD., Grand Cayman, Cayman Islands (KY)

(72) Inventors: Eric Li, Milpitas, CA (US); Shean-Yih Chiou, Milpitas, CA (US); Shang-Kuan Tang, Milpitas, CA (US); Xinchao Peng, Guangdong (CN); Jun Tian, Guangdong (CN); Tianqi Qiu, Guangdong (CN); Yi Zhang, Milpitas, CA (US); Wenjie Yang, Guangdong (CN); Zhe Gong, Guangdong (CN); Yutao Chen, Guangdong (CN)

(73) Assignee: SCT TECHNOLOGY, LTD., Grand Cayman (KY)

( * ) Notice: Subject to any disclaimer, the term of this patent is extended or adjusted under 35 U.S.C. 154(b) by 197 days.

(21) Appl. No.: 14/798,034

(22) Filed: Jul. 13, 2015

(65) Prior Publication Data

US 2017/0018260 A1 Jan. 19, 2017

(51) Int. Cl.

| | |
|---|---|
| ***G09G 3/32*** | (2016.01) |
| ***G09G 5/00*** | (2006.01) |
| ***G09G 3/3208*** | (2016.01) |

(52) U.S. Cl.

CPC ..... *G09G 3/3208* (2013.01); *G09G 3/32* (2013.01); *G09G 5/006* (2013.01); *G09G 2300/026* (2013.01); *G09G 2352/00* (2013.01); *G09G 2360/18* (2013.01); *G09G 2370/042* (2013.01); *G09G 2370/10* (2013.01)

(58) Field of Classification Search

None

See application file for complete search history.

(56) References Cited

U.S. PATENT DOCUMENTS 8,058,815 B1 * 11/2011 Hardy ..... H05B 33/0842 315/291

2002/0163513 A1 * 11/2002 Tsuji ..... G06F 3/1446 345/204

(Continued)

*Primary Examiner* — Joni Richer

(74) *Attorney, Agent, or Firm* — Novick, Kim & Lee, PLLC; Allen Xue

(57) ABSTRACT

A display device is provided. The display device includes a transmitter, a plurality of first receivers, a plurality of second receiver modules, and a plurality of LED driver groups. The transmitter transmits at least one of a configuration data packet and an image data packet. Each of the configuration and image data packets includes a set of field information. At least one first receiver is coupled to the transmitter. Each of the plurality of second receiver modules is coupled to at least one of first receivers. Each of the plurality of second receiver modules includes a plurality of second receivers. Each of the second receivers reads the set of field information so as to determine whether the set of field information is designated thereto. Each of the plurality of LED driver groups is coupled to the at least one of the second receivers. Each of the plurality of LED driver groups includes a plurality of LED drivers. The set of field information includes information of a designated second receiver in the plurality of the second receivers.

23 Claims, 11 Drawing Sheets

(56) References Cited

U.S. PATENT DOCUMENTS

| | | | | |
|---|---|---|---|---|
| 2003/0038771 | A1* | 2/2003 | Sunohara | G09G 3/3688 345/103 |
| 2007/0279353 | A1* | 12/2007 | Oomura | G09G 3/2096 345/87 |

* cited by examiner

DISPLAY DEVICE, METHOD FOR TRANSMITTING DATA PACKET, AND LED SYSTEM

FIELD OF THE INVENTION

This invention relates generally to a display device, a method for transmitting data packet, and a light emitting diode (LED) system.

BACKGROUND OF THE INVENTION

Light emitting diode (LED) is widely used for displaying information and messages. LED is a solid state device that converts electric energy to light. LED display panels provide a higher level of brightness and greater optical efficiency as compared to other types of display panels. Recently, LED display panel has been used to make large indoor or outdoor display panels and televisions.

The design, fabrication, and operation of a large LED display panel face numerous technical challenges. For example, the size of LED display panel can be as large as around 7.35 m×4.1 m. In that case, it is difficult to send a set of data to the designated the LED driver across the LED display panel in a synchronous manner. The set of data can include configuration control bits and pulse-width modulation (PWM) data. Such data control the brightness, color depth, and on-and-off of the LED display.

FIG. 1 is a schematic block diagram of a LED system 1 having a plurality of receiver cards 13, each of the receiver cards 13 being connected to a plurality of LED drivers 14. Referring to FIG. 1, the LED system 1 includes content sources 11, a plurality of send boxes 12, a plurality of receiver cards 13, and a plurality of LED drivers 14. To transmit the set of data to the designated LED driver 14, the LED system 1 requires the plurality of send boxes 12 and the plurality of receiver cards 13. Depending on the configurations of the LED system, the total number of send boxes 12 and receiver cards 13 may vary. A receiver card 13 receives data from a send box 12 via a gigabit Ethernet port. A serially arranged set of LED drivers 14 have access to the plurality of receiver cards 13 to read the data. Each serially arranged set of LED drivers 14 requires a plurality of receiver cards 13. Thus, as the number of LED drivers 14 grows, the number of gigabit Ethernet ports designated to the plurality of receiver cards 13 increases.

Large number receiver cards 13 and ports (not shown) can create at least four following problems. First, the receiver cards 13 use a transformer components (not shown) either in a transmitter port or receiving port. The width and height of the transformer physically limit the size of an ultra-thin LED display panel. Second, a large number of transformers used as high frequency signal coupling devices in the port causes problematic electromagnetic radiation, such as Electromagnetic Interefernce (EMI). Third, a large number of receiver cards 13 require a larger number of switching DC-DC converters, which are not only hard to be integrated into the LED main display board but also create EMI. Fourth, a plurality of receiver cards 13 and gigabit Ethernet ports attached thereto reside in a LED display panel and therefore increase the size of display. Accordingly, a display device, a method for transmitting data packet, and a Light-Emitting Diode (LED) system that overcome the above described shortcomings are needed.

SUMMARY OF THE INVENTION

In view of the aforementioned problems, the present disclosure provides a display device, a method, and a light emitting diode (LED) system for transmitting data packet.

According to an embodiment of the present disclosure, a display device is provided. The display device includes a transmitter, a plurality of modules, and a plurality of LED driver groups. The transmitter transmits at least one of a configuration data packet and an image data packet. Each of the configuration and image data packets includes a set of field information. At least one first receiver is coupled to the transmitter.

Each of the modules is coupled to the at least one first receiver and includes a second receivers. Each of the second receivers includes at least one processor, and at least one memory. Each of the second receivers reads the set of field information so as to determine whether the set of field information is designated thereto.

Each of the plurality of LED driver groups is coupled to the at least one of the second receivers and includes a plurality of LED drivers. Each of the LED driver groups receives at least one of the configuration and image data packets from the at least one of the second receivers, and the set of field information includes information of a designated second receiver in the plurality of the second receivers.

DETAILED DESCRIPTION OF THE PREFERRED EMBODIMENT

Figure 1:
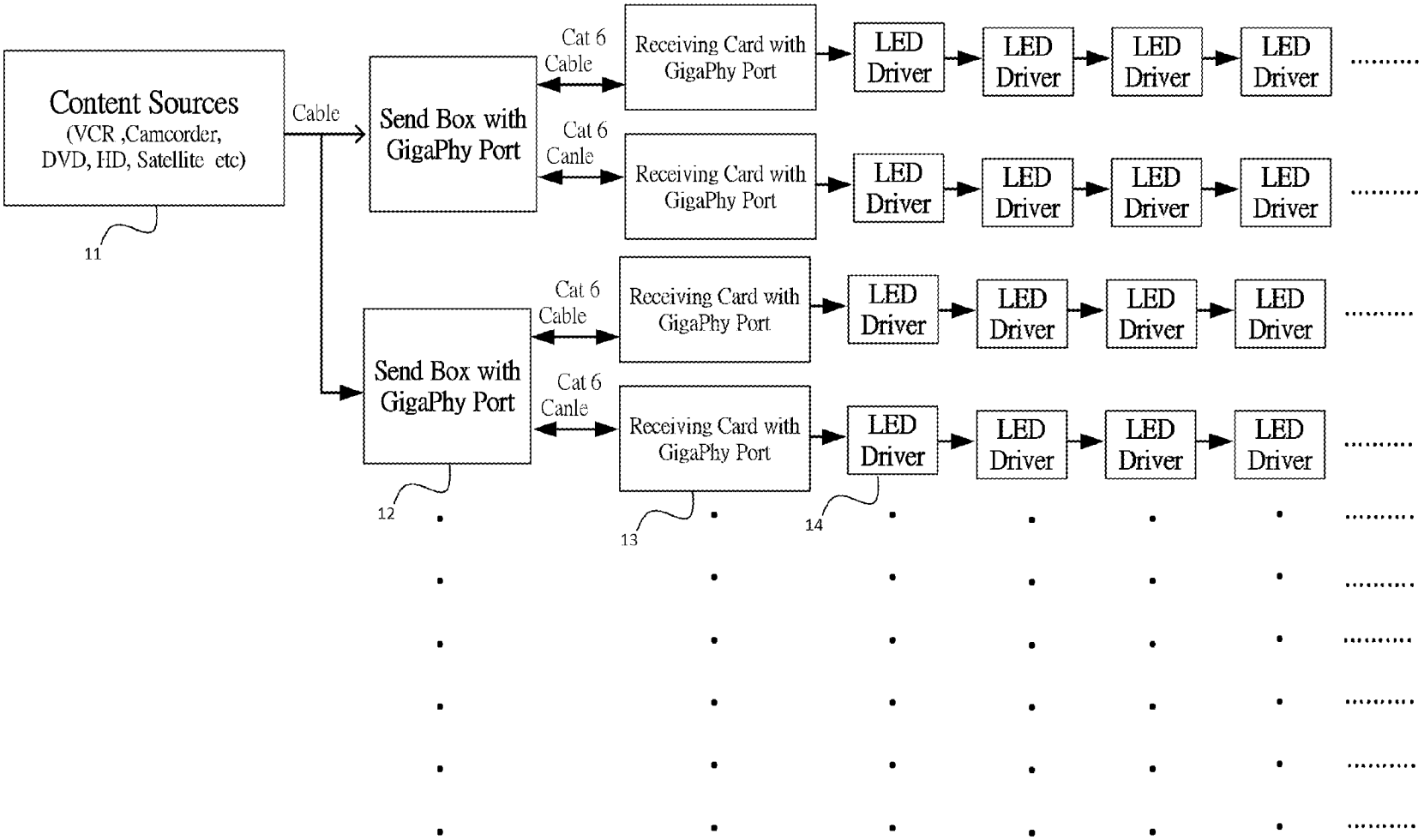
FIG. 1 is a schematic block diagram of a LED system having a plurality of receivers, each of the receivers being connected to a plurality of LED drivers.

Reference will now be made in detail to embodiments, examples of which are illustrated in the accompanying drawings, wherein like reference numerals refer to the like elements throughout the several views. In this regard, the present embodiments may have different forms and should not be construed as being limited to the descriptions set forth herein. Accordingly, the embodiments are merely described below, by referring to the figures, to explain aspects of the present description. Terms used herein are for descriptive purposes only and are not intended to limit the scope of the disclosure. The terms "comprises" and/or "comprising" are used to specify the presence of stated elements, steps, operations, and/or components, but do not preclude the presence or addition of one or more other elements, steps, operations, and/or components. The terms "first," "second," and the like may be used to describe various elements, but do not limit the elements. Such terms are only used to distinguish one element from another. These and/or other aspects become apparent and are more readily appreciated by those of ordinary skill in the art from the following description of embodiments of the present disclosure, taken in conjunction with the accompanying drawings. The figures depict embodiments of the present disclosure for purposes of illustration only. One skilled in the art will readily recognize from the following description that alternative embodiments of the structures and methods illustrated herein may be employed without departing from the principles of the disclosure described herein.

Figure 2:
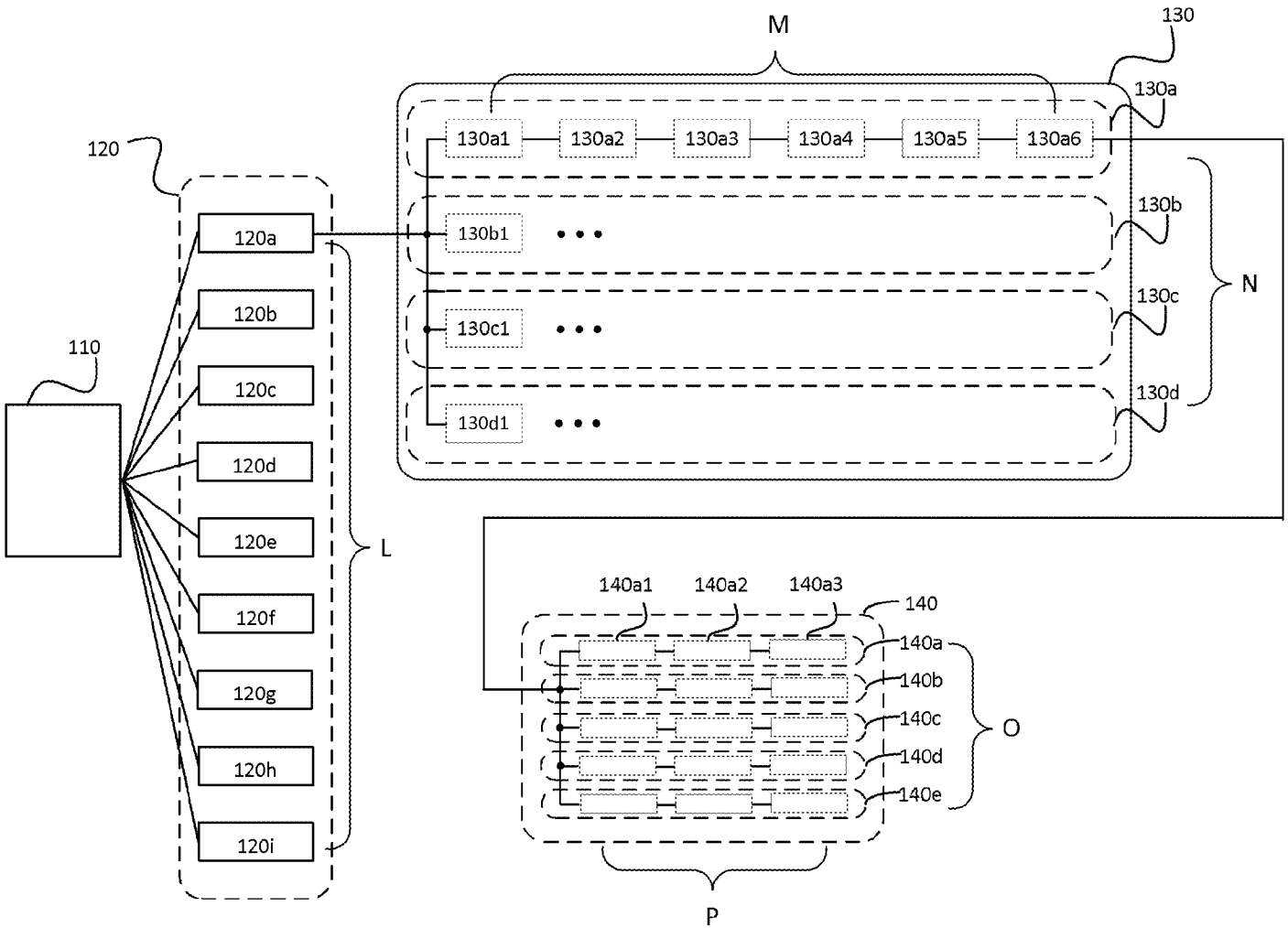
FIG. 2 is a schematic block diagram showing a configuration of a LED system having first receivers, second receivers, and LED drivers according to an embodiment of the present disclosure.
Figure 3:
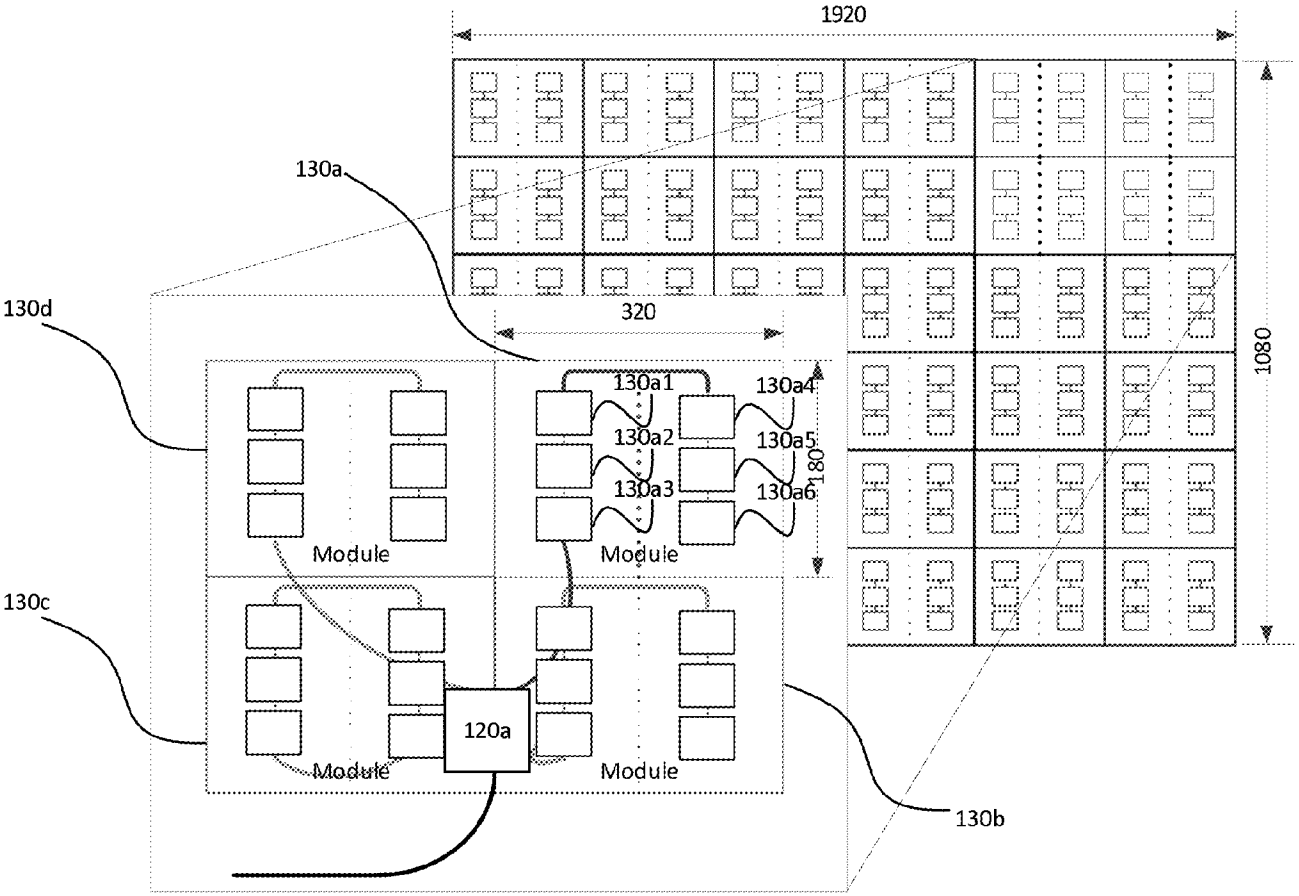
FIG. 3 is a schematic block diagram showing first and second receivers shown in FIG. 2 arranged in the LED display panel.
Figure 4:
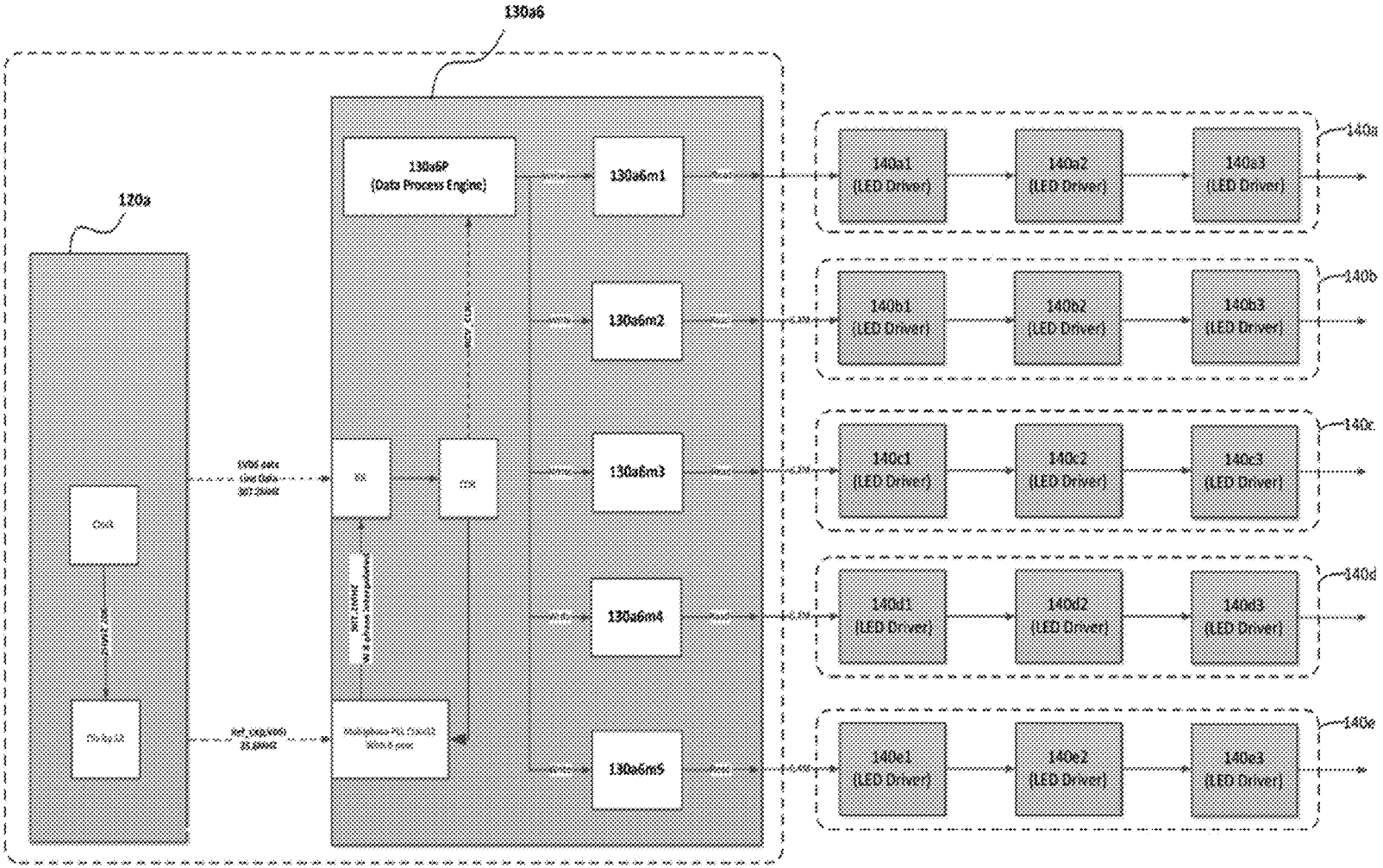
FIG. 4 is a detailed schematic block diagram illustrating one set of the first and second receivers, and their connections to a plurality of LED drivers.

Referring now to FIGS. 2-4, an embodiment of the present disclosure will be described. FIG. 2 is a schematic block diagram showing a configuration of a light emitting diode (LED) system 100. LED system 100 includes transmitter 110, a first receivers 120, a plurality of second receiver 130, and a plurality of LED drivers 140.

According to one embodiment of the current disclosure, Transmitter 110 receives data from various content sources, such as a VCR player, a camcorder, a HD-DVD player, and/or a satellite.

First receivers 120, second receivers 130, and LED drivers 140 are described in detail below. For the purpose of simplicity, unless otherwise indicated herein, reference numeral 120 refers to a plural number of first receivers while a specific first receiver may be referred to with reference numeral 120 followed by an alphabet, e.g., 120*a*. Similarly, reference numeral 130 refers to a plural number of second receivers. A second receiver module containing a plural number of second receivers may be referred to with reference numeral 130 followed by an alphabet, e.g., 130*a*. A specific second receiver may be referred to with reference numeral 130 followed by an alphabet and a number, e.g., 130*a*1. Similarly, reference numeral 140 refers to a plural number of LED drivers while a specific LED driver may be referred to with reference numeral 140 followed by an alphabet and a number, e.g., 140*a*1. A LED driver group containing a plural number of LED drivers is referred to with reference numeral 140*a*.

As shown in FIG. 2, first receivers 120 is coupled to transmitter 110. Transmitter 110 sends various signals and data from the contents sources to first receivers 120. First receivers 120 can have plural input and output ports (not shown), which are connected to transmitter 110. Each of input and output ports can have CAT5/CAT6 cable with gigabits data rate when first receivers 120 are communicated with transmitter 110. First receivers 120 can include L number of first receivers. For the purpose of exemplary illustration only, first receivers 120 can include nine (9) first receivers such as 120*a*, 120*b*, 120*c*, 120*d*, 120*e*, 120*f*, 120*g*, 120*h*, and 120*i*.

As shown in FIG. 2, second receivers 130 are coupled to a corresponding first receiver 120. Second receivers 130 receive various signals and data from first receivers 120, and transmit the same to LED drivers 140.

Second receivers 130 may have N number of second receiver modules. As shown in FIG. 2, for instance, second receivers 130 have four (4) second receiver modules 130*a*, 130*b*, 130*c*, and 130*d*.

Each of L number of first receivers 120 is coupled to each one of N number of second receiver modules. For instance, first receiver 120*a* is coupled to each one of four (4) second receiver modules 130*a*, 130*b*, 130*c*, and 130*d*. N number of second receiver modules e.g. 130*a*, 130*b*, 130*c*, and 130*d* may be parallelly coupled to first receiver 120*a*.

Each of N number of second receiver modules, e.g. 130*a*, 130*b*, 130*c*, and 130*d* may include M number of second receivers, e.g. 130*a*1, 130*a*2, 130*a*3, 130*a*4, 130*a*5, and 130*a*6. M number of second receivers e.g. 130*a*1, 130*a*2, 130*a*3, 130*a*4, 130*a*5, and 130*a*6 may be serially arranged among themselves. Thus, with respect to the number of first receivers 120 and second receivers 130, there are L number of first receivers 120 and L×M×N number of second receivers 130. Second receivers 130 can be configured to support FCCL (full content cycle lighting), Calibration data, and Gamma Table correction.

Each of first receivers 120 can transmit data in Low Voltage Differential Signaling (LVDS) format to second receivers 130. LVDS may be transmitted at 307.2 MHz signal rate, and when 8B/10B code used, real data rate may be around 245.76M. 8B/10B encoding addresses the coding process that each incoming octet passed down and encodes it into a ten bit code group. Each octet is given a code group name according to the bit arrangement.

The configuration shown in FIG. 2 has technical advantages because it requires less transformers and Gigabit Ethernet ports in comparison to the prior art. As the prior art example illustrated in FIG. 1, for example, each of the receivers requires a transformer and a gigabit Ethernet port. The resulting large number of transformers and gigabit Ethernet ports generate EMI and occupy valuable spaces. However, according to the present disclosure, only first receivers 120 requires transformers and gigabit Ethernet ports to communicate with sending box or PC. In other words, only L number of first receivers 120, instead of L×(M×N) receivers, requires transformers and gigabit Ethernet ports. That is because of the fact that each of first receivers 120 can transmit data in Low Voltage Differential Signaling (LVDS) format to second receivers 130, instead of Gigabit Ethernet ports. Accordingly, having two types of receiver units and adopting LVDS format for communications between them reduces number of transformers and Gigabit Ethernet ports. Another advantage according to the present disclosure includes that the conventional sending card, 1st receiver cards, 2nd receiver cards can be replaced with ASIC chip, which occupies a comparatively small space in a way that the present disclosure describes. Thus, LED Display Panels according to the present disclosure can be configured to have a very compact structure.

LED drivers 140 are electrical devices that regulate the power or signal to LEDs or string(s) of LEDs. Each of second receivers, e.g. 130*a*6 is coupled to each one of O number of LED driver groups, e.g. 140*a*, 140*b*, 140*c*, 140*d*, and 140*e*. Each of O number of LED driver groups, e.g. 140*a* includes P number of LED drivers, e.g. 140*a*1, 140*a*2, and 140*a*3. In other words, first module sixth ($6^{th}$) second receiver 130*a*6 is coupled to fifteen (15) LED drivers (five LED driver groups×three LED drivers). LED driver Groups 140*a*, 140*b*, 140*c*, 140*d*, and 140*e* are parallelly coupled to second receiver, e.g. 130*a*6. LED drivers 140*a*1, 140*a*2, and 140*a*3 are serially arranged.

FIG. 3 is a schematic block diagram showing an arrangement of first and second receivers 120 and 130 across the LED display panel 101. LED display panel 101 has a resolution of 1920×1080 pixels. According to one aspect of the invention, as shown in FIG. 3, there are nine (9) first receivers e.g. 120*a* and four second receiver modules 130*a*, 130*b*, 130*c*, and 130*d* are coupled to first receiver 120*a*. Each of second receiver modules 130*a*, 130*b*, 130*c*, and 130*d* includes six (6) second receivers e.g. 130*a*1, 130*a*2,

130*a*3, 130*a*4, 130*a*5, and 130*a*6. Since first receivers 120 and second receivers 130 may be disposed on the display device as chip components, the size of the LED system 100 can be minimized, and thus compact LED display panel 101 can be fabricated.

Transmitters 110 can be any form of sending cards, sending boxes, and personal computer with Eithernet gigabit port. The plurality of transmitters 110 can be disposed on the outside of LED display panel 101. Alternatively, transmitters 110 can be a gigabit port input and LVDS port with Clock Date Recovery (CDR) output, which are implemented in FPGA or/and ASIC. In this case, transmitters 110 can be disposed on LED display panel 101, as well.

LED display panel 101 can include a volume of discrete LED pixels, and processors. Since a great number of components exist on LED display panel 101, due to the discrepancy among the components, various conditions of LED display panel 101, including color and luminance can vary. Thus, calibration process is needed.

After the calibration process, the calibration data can be stored in a flash memory so that, while in a power up stage as requested by a controller, the calibration data can be used as reference data for each of LED drivers 140 so as to make the LED display panel 101 more uniform in color and luminance.

FIG. 4 is a detailed schematic block diagram showing one set of the first receiver 120*a*, sixth (6th) second receiver 130*a*6, and LED drivers 140. The first receiver 120*a* can be coupled to 130*a*6 through the first ($1^{st}$), second ($2^{nd}$), third ($3^{rd}$), fourth ($4^{th}$), and fifth ($5^{th}$) second receiver 130*a*1, 130*a*2, 130*a*3, 130*a*4, 130*a*5, and 130*a*6. FIG. 4 depicts that first receiver 120*a* is coupled to sixth ($6^{th}$) second receiver 130*a*6. Sixth ($6^{th}$) second receiver 130*a*6 is coupled to five LED driver groups 140*a*, 140*b*, 140*c*, 140*d*, and 140*e*. For the purpose of exemplary only, sixth ($6^{th}$) second receiver 130*a*6 is described only; however, each one of second receivers 130*a*1, 130*a*2, 130*a*3, 130*a*4, and 130*a*5 can have same or similar function therewith. Sixth ($6^{th}$) second receiver 130*a*6 includes processor 130*a*6*p*. Processor 130*a*6*p* can include a register memory. Processor 130*a*6*p* and the register memory can be coupled to first memories 130*a*6*m*1, 130*a*6*m*2, 130*a*6*m*3, 130*a*6*m*4, and 130*a*6*m*5. First memories 130*a*6*m*1, 130*a*6*m*2, 130*a*6*m*3, 130*a*6*m*4, and 130*a*6*m*5 are paralelly arranged among themselves and have static random access memories (SRAMs).

Figure 5:
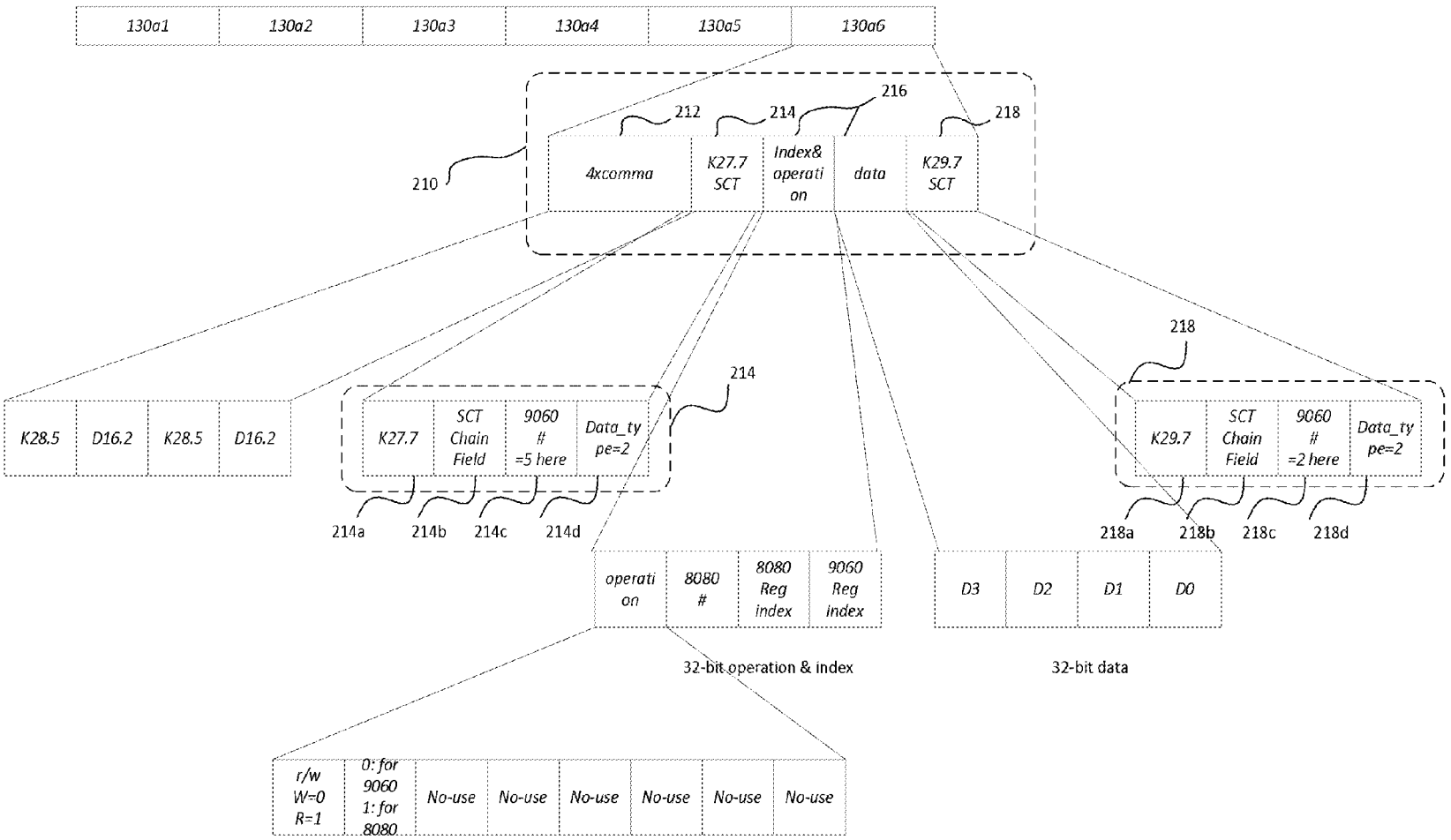
FIG. 5 is a block diagram illustrating a configuration data packet structure.
Figure 6:
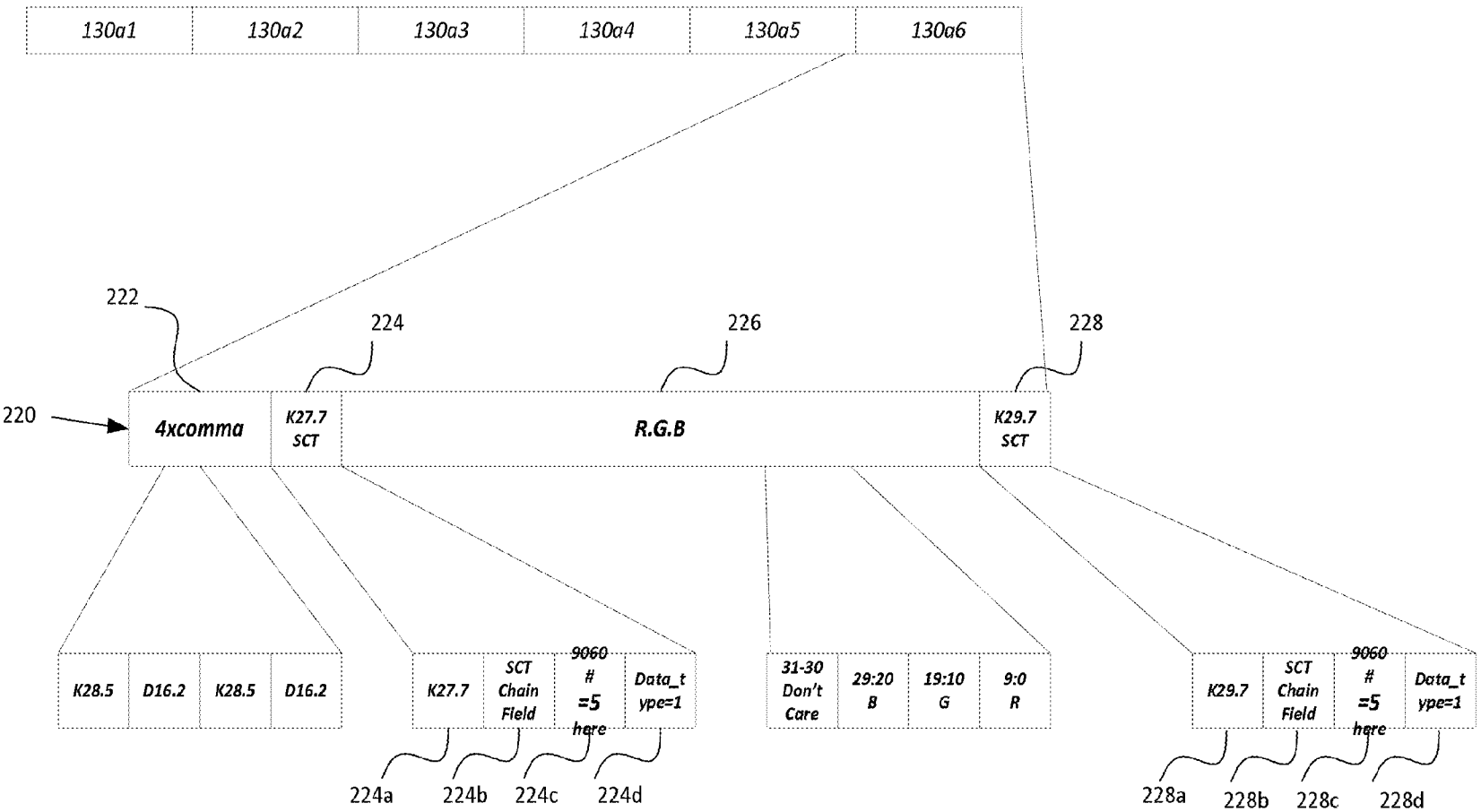
FIG. 6 is a block diagram illustrating an image data packet structure.

FIG. 5 is a block diagram illustrating a structure of a configuration data packet 210. FIG. 6 is a block diagram illustrating a structure of a image data packet 220. PWM data, configuration register data, and flash memory data can be transmitted from each of first receivers 120 to plurality of second receivers 130. It is important to transmit such data to the designated second receiver or LED driver in a synchronous manner. Referring to FIGS. 5 and 6, data packet structure is described as to how to transmit data from first receivers 120 to designated second receivers 130 in a synchronous manner. In a similar manner, data can be transmitted from second receivers 130 to LED drivers 140.

Each of configuration data packet 210 and image data packet 220 includes a comma 212 and 222, a first segment 214 and 224, a second segment 216 and 226, and a third segment 218 and 228. Configuration data packet 210 and image data packet 220 contain different data modes: configuration data and image date, respectively. Image data can include PWM and flash memory, LED Driver's configuration and control data. Since configuration data packet 210 and image data packet 220 have similar data structure, for the purpose of simplicity, configuration data packet 210 and image date packet 220 will be described together below, or if necessary configuration data packet 210 only.

A comma 212 and 222 is a special sequence of bits, and works as a preamble of the data packet. The notation used for ordered sets is similar to that used for code groups. Code groups are written as either /Dx.y/ or /Kx.y/ as shown in FIGS. 5 and 6. Although FIG. 5 and FIG. 6 depicts 4×comma, it is for exemplaray purpose only. Thus, embodiments according to the present description may have, for instance, 5×, 6×, 7×, 8×, and 10×comma.

In particular, ordered sets of K28.5 is used in comma 212 and 222 as the first code group because it contains a comma 212 and 222. K28.5 is a unique data pattern as defined in advance. The reception of K28.5 will not happen during data packet process unless there is a data error. Thus, this makes it useful for use with specific ordered sets such as a starting point of an idle or configuration.

First segment 214 and 224 includes a start of frame 214*a* and 224*a*, set of field information 214*b*, 214*c*, 224*b*, and 224*c*, and data mode information 214*d* and 224*d*. A data packet on the wire is called a frame and consists of binary data. A start of frame 214*a* and 224*a* marks a starting point of packet frames. Set of field information 214*b*, 214*c*, 224*b*, and 224*c* will be described in detail with reference to FIGS. 7A and 7B. Data mode information 214*d* and 224*d* indicates as to whether the data information is configuration data or image data.

Second segment 216 and 226 contains data information. For example, second segment of configuration data packet 216 includes configuration information. Configuration information includes index and operation information, and configuration data. For example, operation information can include read/write instructions. Index information can include whether the designation of the data packet is second receivers 130 or LED driver 140. Configuration data can include detailed configuration data 210 and a part of configuration data space can be reserved for future use. Second segment of image data packet 226 includes image data such as red-green-blue (RGB) data.

Third segment 218 and 228 includes an end of frame 218*a* and 228*a*, a set of field information 218*b*, 218*c*, 228*b*, and 228*c*, and data mode information 218*d* and 228*d*. Third segment 218 and 228 has similar structure with first segment 214 and 224. End of frame 218*a* and 228*a* marks an ending point of packet frames.

Figure 7A:
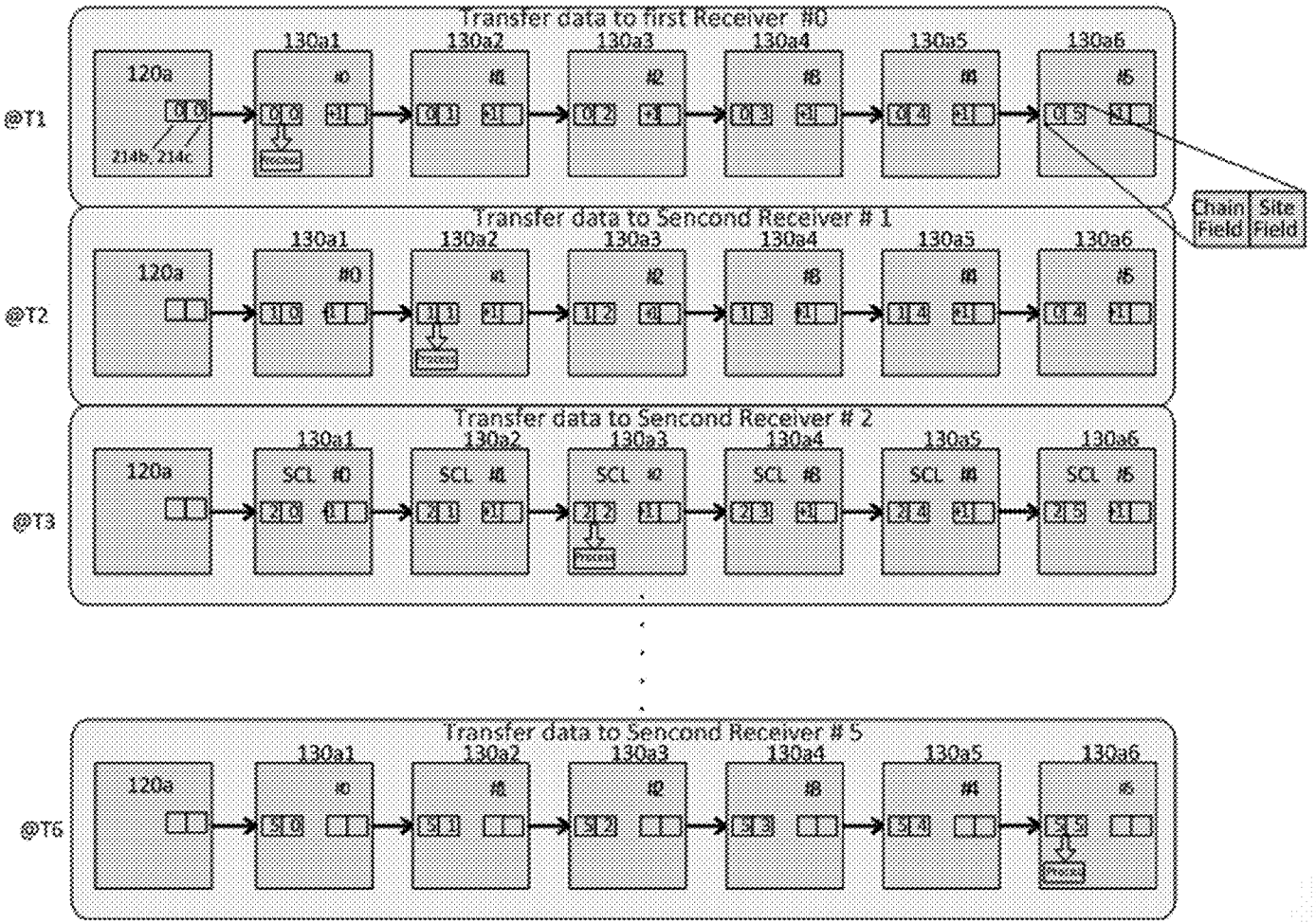
FIGS. 7A and 7B are block diagrams illustrating a method to change a first field information and a second field information.

Referring now to FIG. 7A and FIG. 5, set of field information 214*b*, 214*c*, 218*b*, and-218*c* will be described. Configuration data packet in first segment 214*b* and 214*c* has same structure and value with configuration data packet in third segment 218*b* and 218*c*. Thus, for the purpose of simplicity, only configuration data packet in first segment 214*b* and 214*c* will be described hereafter. Configuration data packet in first segment 214*b* and 214*c* includes a first field information 214*b* and a second field information 214*c*.

First receivers 120 can initially set up the "K27.7_SCT" and "K29.7_SCT"'s first field information 214*b* and second field information 214*c*. According to one embodiment of the current disclosure, for example, first receivers 120 can set up first field information 214*b* as zero value (0) and second field information 214*c* as 0, 1, 2, 3, 4, and 5, which correspond to each of second receivers 130 respectively, where six (6) second receivers 130 are serially arranged. First ($1^{st}$) second receiver 130*a* can receive zero value (0) of first field information 214*b* and adds one (1) value thereto. First ($1^{st}$) second receiver 130*a* then transmits the value of one (1) to next second ($2^{nd}$) second receiver 130*b* and add one (1) value thereto again. Each second receivers 130 compares first and second field information 214*b* and 214*c* whether they match or not. If first and second field information 214*b* and 214*c* are matched, the second receiver 130 received the data packet. If first and second field information 214*b* and 214*c* does not match one another, the second receiver 130 does not receive that data packet. In this way, the second receiver 130 receives correctly assigned data and control command which are assigned to the second receiver 130. For instance, this protocol can be used for up to 256 ($2^8$) second receivers which are serially connected one another. However, the number is not limited to the above example. For example, if 12 bits are selected to express the field information, this protocol can be used for up to 4096 ($2^{12}$) second receivers, which are serially connected one another. Each of the second receivers' address and data is initially automatically programmed to be matched by the first receiver.

For example, referring now to FIG. 5 and FIG. 7A, at T1, the first ($1^{st}$) second receiver 130*a*1 is connected to the first receiver 120*a*. The first ($1^{st}$) second receiver 130*a*1 recognizes that the first ($1^{st}$) field value of the $1^{st}$ "K27.7_SCT" is zero (0) and second ($2^{nd}$) field value is also zero (0). Since first ($1^{st}$) field value matches $2^{nd}$ field value, the first ($1^{st}$) second receiver 130*a*1 receives the data which are contained after the first ($1^{st}$) K27.7_SCT and replaces the first ($1^{st}$) field by adding one (1) and sends the modified content to next second ($2^{nd}$) second receiver 130*a*2. At T2, the second ($2^{nd}$) second receiver 130*a*2, which is connected to the first ($1^{st}$) second receiver 130*a*1, checks a first ($1^{st}$) field value of K27.7_SCT, which is one (1), and a second ($2^{nd}$) field value which is also one (1). Since the first ($1^{st}$) field value matches second ($2^{nd}$) field value, the second ($2^{nd}$) second receiver 130*a*2 receives the data, which are contained after the $2^{nd}$ K27.7_SCT, and replaces the first ($1^{st}$) field by adding value one (1) and sends the modified content to next third ($3^{rd}$) second receiver 130*a*3.

At T3, the third ($3^{rd}$) second receiver is connected to the second ($2^{nd}$) second receiver 130*a*2 and checks the first ($1^{st}$) field value of the third ($3^{rd}$) K27.7_SCT. The first ($1^{st}$) field value is two (2) and the second ($2^{nd}$) field value is two (2). Since the first ($1^{st}$) field value matches the second ($2^{nd}$) field value, the third ($3^{rd}$) second receiver 130*a*3 receives the data, which is contained after the third ($3^{rd}$) of K27.7_SCT, and replaces the first ($1^{st}$) field by adding value one (1) and sends the modified content to next second receiver 130*a*4. At T4 (not shown) the fourth ($4^{th}$) second receiver 130*a*4 is connected to the third ($3^{rd}$) second receiver see the first ($1^{st}$) field value of the 4th K27.7_SCT. First ($1^{st}$) field value is three (3) and the second ($2^{nd}$) field value three (3). Thus, the $1^{st}$ field value matches second ($2^{nd}$) field value. Then the 4th second receiver receives the data, which is contained after the fourth ($4^{th}$) of K27.7_SCT and replaces the first ($1^{st}$) field by adding value one (1) and sends the modified content to next second receiver.

At T5 (not shown), the fifth ($5^{th}$) second receiver is connected to the fourth ($4^{th}$) second receiver and checks the first ($1^{st}$) field value of the fifth ($5^{th}$) K27.7_SCT. The first ($1^{st}$) field value is four (4) and the second ($2^{nd}$) field value is four (4). Since the first ($1^{st}$) field value matches the second ($2^{nd}$) field value, the fifth ($5^{th}$) second receiver receives the data, which is contained after the fifth ($5^{th}$) of K27.7_SCT and replaces the first ($1^{st}$) field by adding value one (1) and sends the modified content to next second receiver. At T6, the sixth ($6^{th}$) second receiver is connected to the fifth ($5^{th}$) second receiver and checks the first ($1^{st}$) field value of the ($6^{th}$) K27.7_SCT. The first ($1^{st}$) field value is five (5) and the second ($2^{nd}$) field value is five (5). Since the first ($1^{st}$) field value matches the second ($2^{nd}$) field value, the sixth ($6^{th}$) second receiver receives the data. Each and every second receiver 130*a* compares the first ($1^{st}$) field value and second ($2^{nd}$) field value of the data packet (214) sent from the first ($1^{st}$) receiver 120*a*. Each and every second receiver 130*a* can be configured to receive the packet data if the first ($1^{st}$) field value matches the second ($2^{nd}$) field value and otherwise does not receive the date. Each of second receivers 130*a* receive assigned data and control command which are assigned to the right second receiver 130*a*. This protocol can cover up to 256 ($2^8$) second receivers 130*a*, which are serially connected one another.

Figure 7B:
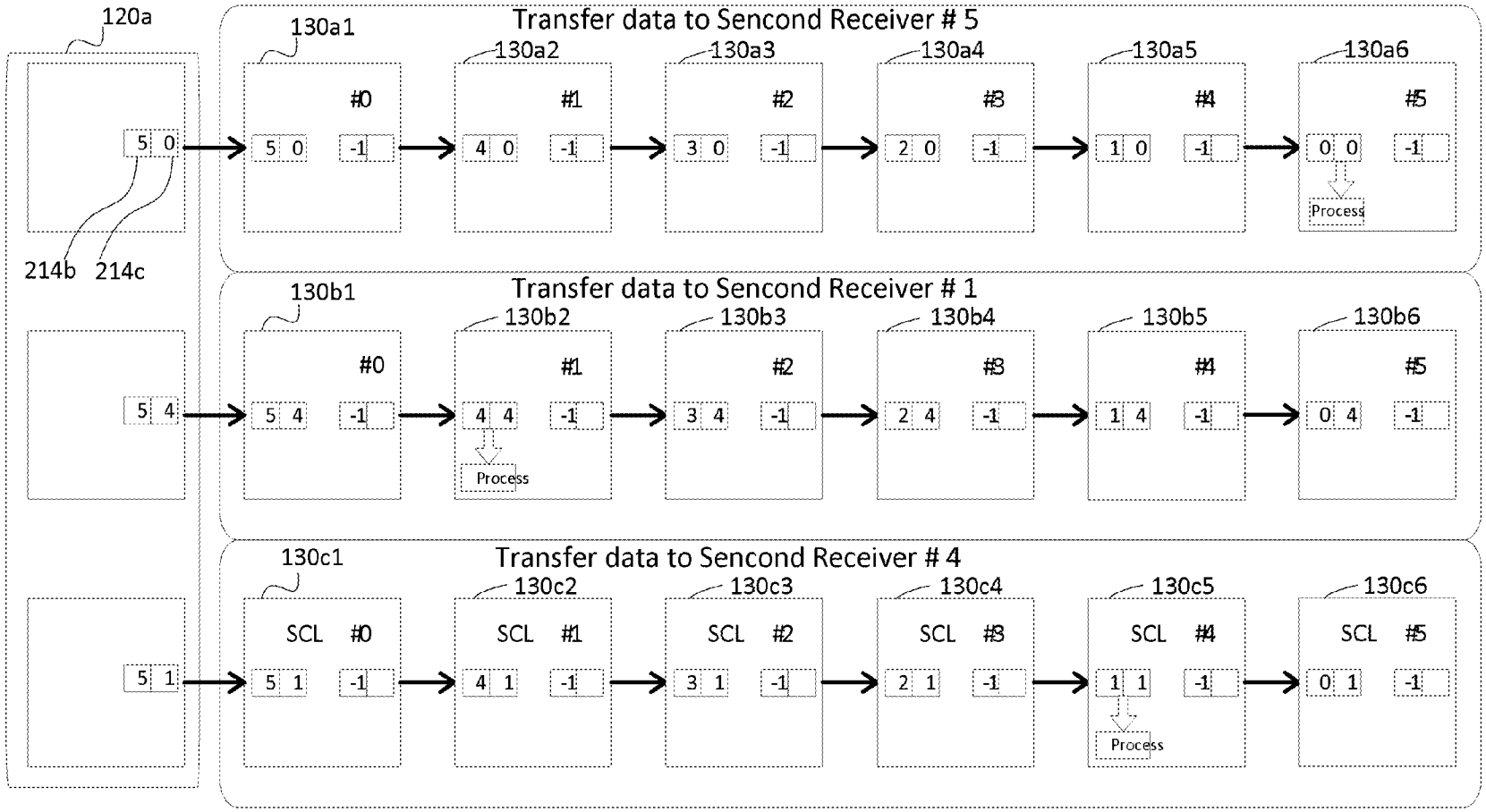

According to another embodiment of the current disclosure, as shown in FIG. 7B, the first field information 214*b* can have a number subtracted one (1) from a total number of the second receivers 130*a*. It can be expressed by Y-1, where Y refers to the total number of second receivers 130. Second field information 214*c* can be set up to indicate an address of a targeted second receiver to which configuration data packet 210 is designated to convey. For example, if configuration data packet 210 is designated to Xth second unit receiver, a value of second field information 214*c* can be set as Y-X.

In particular, for example, one of first receivers 120*a* can set up first field information 214*b* to have five (5) value a total number (6) of second receivers 130*a* minus one (1). Regarding second field information, the total number of second unit receivers 130*a*1, 130*a*2, 130*a*3, 130*a*4, 130*a*5, and 130*a*6 in first module 130*a* is six (6), and thus Y is six (6). If configuration data packet 210 is designated to sixth ($6^{th}$) second unit receiver in first module 130*a*6, second field information 214*c* can be set as zero (0), Y(6)-X(6). In another example, if configuration data packet 210 is designated to second ($2^{nd}$) second receiver 130*b*2 in second module 130*b*, second field information 214*c* can be set up as four (4), Y(6)-X(2). In the other example, if configuration data packet 210 is designated to fourth ($5^{th}$) second unit receiver 130*c*5 in third module 130*c*, second field information 214*c* can be set as one (1), Y(6)-X(5).

Set of field information of the configuration data packet 214*b* and 214*c* are configured to be changed sequentially adding or subtracting a predetermined value therefrom when passed in or out of at least one second receiver 130*a*1. Referring to FIGS. 2 and 7, it is described that data are transmitted from first receivers 120*a* to sixth ($6^{th}$) second receiver 130*a*6 in first module 130*a*; from first receivers 120*a* to second ($2^{nd}$) second receiver 130*b*2 in second module 130*b*; and/or from first receivers 120*a* to fifth ($5^{th}$) second receiver 130*c*5 in third module 130*c*, respectively.

First ($1^{st}$) second receiver 130*a*1 coupled to first receiver 120*a* receives configuration data packet 210. Configuration data packet 210 is designated to sixth ($6^{th}$) second receiver 130*a*6 in first module 130*a*. As explained above, first field information of second receivers 130*a* is five (5). Ordered pair of first and second field information is (5,0) as indicated in FIG. 7B. First ($1^{st}$) second receiver 130*a*1 compares first field information 214*b* (5) and second field information 214*c* (0). If first field information 214*b* and second field information 214*c* have same value, then first ($1^{st}$) second receiver 130*a*1 receives and processes configuration data packet 210. Since first field information 214*b* (5) and second field information 214*c* (0) do not match one another, first ($1^{st}$) second receiver 130*a* determines that configuration data packet 210 is not designated thereto, and does not process or execute configuration data packet 210 and passes the same onto next receiver, which is second ($2^{nd}$) second receiver 130*a*2. When configuration data packet 210 passes in or out, first ($1^{st}$) second receiver 130*a*1 subtracts a predetermined value from first field information 214*b*. For example, if the predetermined value is one (1), first field information 210 is changed from five (5) to four (4). Thus, ordered pair of first and second field information 214*b* and 214*c* now becomes (4,0). After the subtraction, first ($1^{st}$) second receiver 130*a*1 passes configuration data packet 210 onto next second ($2^{nd}$) second receiver 130*a*2. Second ($2^{nd}$) second receiver 130*a*2 compares first field information 214*b* (5) and second field information 214*c* (0). Thus, now first field information is four (4) and second field information is zero (0). It does not match one another. Thus, second ($2^{nd}$) second receiver 130*a*2 makes ordered pair of first and second field information from (4,0) to (3,0), and passes configuration data packet 210 onto next receiver.

As illustrated in FIG. 7B, when configuration data packet 210 arrived at sixth ($6^{th}$) second receiver 130*a*6, ordered pair of first and second field information 214*b* and 214*c* becomes (0,0). Sixth ($6^{th}$) second receiver 130*a*6 compares first field information 214*b* (0) and second field information 214*c* (0), now both have same value zero (0). Thus, sixth ($6^{th}$) second receiver 130*a*6 determines that configuration data packet 210 is designated to sixth ($6^{th}$) second receiver 130*a*6, and processes or executes any predetermined actions. Such process or execution can include read and write configuration data packet 210 from or onto a memory (not shown) resides in sixth ($6^{th}$) second receiver 130*a*6. In doing so, first receiver 120*a* can transmit configuration and image data packet 210 and 220 to the designated sixth ($6^{th}$) second receiver 130*a*6. This protocol can be used for up to 256 ($2^8$) second receivers which are serially connected one another. However, the number is not limited to the above example. For example, if 12 bits are selected to express the field information, this protocol can be used for up to 4096 ($2^{12}$) second receivers, which are serially connected one another. Each of the second receivers' address and data is initially automatically programmed to be matched by the first receiver.

Configuration data packet 210 and/or image data packet 220 include(s) numerous commands, which are defined for LED driver 140 and for flash memory control. Commands can be defined by a host personal computer or send box. Commands can be broadcasted to across first receivers 120 and be transmitted to second receivers 130. Second receivers 130 can generate pattern system clocks and data receiving control signal for LED drivers 140 based on the reference clock from first receivers 120. The pattern system clocks and data receiving control signals for LED driver 140 are generated by each of second receivers' 130 Clock Date Recovery (CDR) block. Each of second receivers 130 does need a reference clock from the first receivers 120 so as to keep an accuracy of the frequency.

Referring to FIG. 7B, another example also describes how configuration data packet 210 is transmitted from first receivers 120*a* to second ($2^{nd}$) second receiver 130*b*2 in second module 130*b*. In FIG. 7B, Ordered pair of first and second field information is (5,4). According to the process described above with respect to Sixth ($6^{th}$) second receiver 130*a*6, second ($2^{nd}$) second receiver 130*b*2 in second module 130*b* compares first field information 214*b* (4) and second field information 214*c* (4). Since first field information 214*b* (4) and second field information 214*c* (4) have same value, second ($2^{nd}$) second receiver 130*b*2 determines that configuration data packet 210 is designated thereto, and performs necessary process with configuration data packet 210. And then, second ($2^{nd}$) second receiver 130*b*2 subtracts one from first field information passes configuration data packet onto next third ($3^{rd}$) second receiver 130*b*3. Regarding other second receivers 130*b*1, 130*b*3, 130*b*4, 130*b*5, and 130*b*6 in second module 130*b*, each of them determines that first field information 214*b* does not match with second field information 214*c*. Thus, each of other second receivers 130*b*1, 130*b*3, 130*b*4, 130*b*5, and 130*b*6 in second module 130*b* passes configuration data packet 214*b* onto next second receiver.

Referring to FIG. 7B, third example describes how configuration data packet 210 is transmitted from first receivers 120*a* to fifth ($5^{th}$) second receiver 130*c*5 in third second receiver module 130*c*. Ordered pair of first and second field information is (5,1). All second receivers 130*c*1, 130*c*2, 130*c*3, 130*c*4, 130*c*5 and 130*c*6 in third second receiver module 130*c* subtract one from first field information and passes configuration data packet 210 onto next second receiver. Only fifth ($5^{th}$) second receiver 130*c*5 processes and executes configuration data packet 210.

Figure 8:
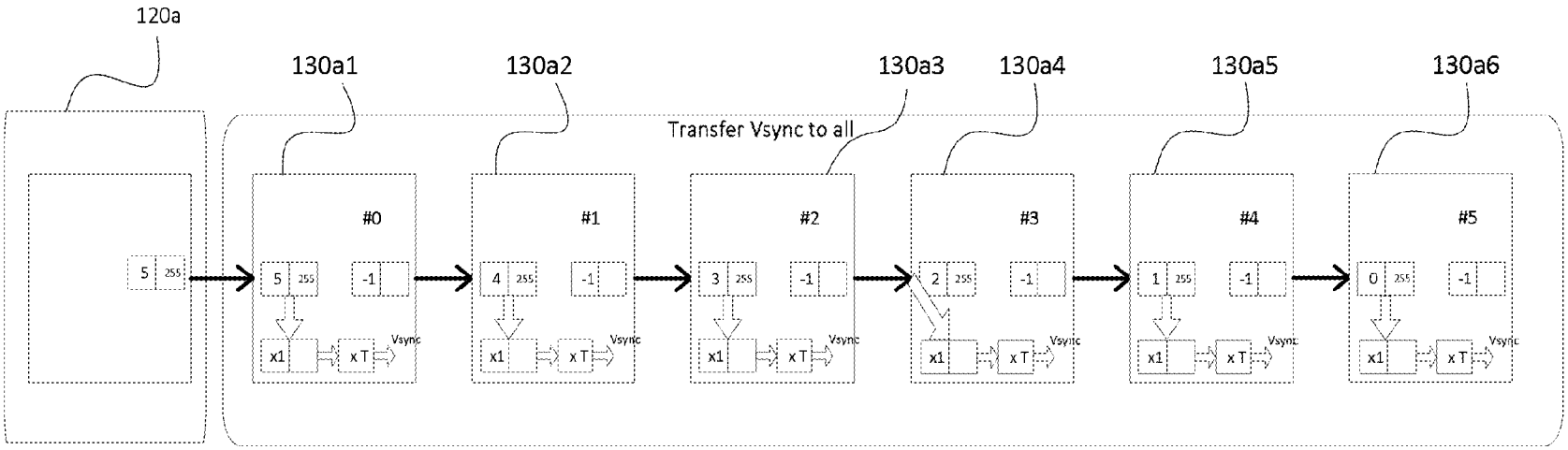
FIG. 8 is a block diagram illustrating a method to calculate a delay value.

FIG. 8 is a block diagram showing a calculation of Vsync signal delay value. It is important to distribute data and signals across plurality of LED drivers in a synchronized manner. Vsync signal can be used as an alignment flag among LED drivers. A latency among the LED drivers could cause a command synchronization problem. In this regard, a configuration register of "Vsync delay" can be defined as a synchronization number and by adjusting the value of synchronization number, synchronization problem can be overcomed.

First module 130*a* includes six (6) serially arranged second receivers 130*a*1, 130*a*2, 130*a*3, 130*a*4, 130*a*5, and 130*a*6. Latency from each of second receivers 130*a*1, 130*a*2, 130*a*3, 130*a*4, 130*a*5, and 130*a*6 to LED drivers can create synchronization problems. To attenuate such latency problems, set of field information 214*b* and 214*c* can be used. Configuration data packet 210 can include a delay value which reflects the change of first field information 214*b*. Thus, each of second receivers 130*a*1, 130*a*2, 130*a*3, 130*a*4, 130*a*5, and 130*a*6 can determine a period of delay time transmitting at least one of configuration data packet 210 and/or image data packet 220 to LED drivers 140 according to delay value.

In particular, referring to FIG. 8, first ($1^{st}$) second receiver 130*a*1 coupled to first receiver 120*a* receives configuration data packet 210. First field information 214*b* of configuration data packet 210 is five (5) as explained above. Second field information has a synchronization number. The synchronization number can be any number which is defined in advance and is distinguishable from general second field number 214*c*. For example, as illustrated in FIG. 8, the synchronization number can be two hundred fifty five (255). Thus, when any second receivers 130*a*1, 130*a*2, 130*a*3, 130*a*4, 130*a*5, and 130*a*6 receive set of field information having the synchronization number, they recognize first field information 214*b* as delay value.

Referring to FIG. 8, first ($1^{st}$) second receiver 130*a*1 receives the synchronization number (255). First ($1^{st}$) second receiver 130*a*1 reads value of first field information 214*b* as delay value. When configuration data packet 210 passes onto next second receiver, first ($1^{st}$) second receiver 130*a*1 subtracts a predetermined value from first field information 214*b*. Where the predetermined value is one (1), the value of first field information 214*b* is changed from five (5) to four (4).

Second ($2^{nd}$) second receiver 130*a*2 receives first field information 214*b*, which now becomes four (4), and recognizes it as a delay value. Likewise, delay value for second receivers 130*a*3, 130*a*4, 130*a*5, 130*a*6 are three (3), two (2), one (1), and zero (0), respectively.

Since sixth ($6^{th}$) second receiver 130a6 has zero (0) delay value, when the sixth ($6^{th}$) second receiver 130a6 transmits data and signals to LED drivers 140, the transmission time becomes a synchronization time for other second receivers 130a1, 130a2, 130a3, 130a4, and 130a5. Accordingly, when first ($1^{st}$) second receiver 130a1 transmits data or signal to LED drivers 140, it uses the delay value (5) to calculate a period of a delay time so that the transmission time of data from first ($1^{st}$) second receiver can be synchronized with the synchronization time according to the delay time. In a similar way, transmission times from each of second receivers 130a1, 130a2, 130a3, 130a4, and 130a5 can be synchronized with the synchronization time of sixth ($6^{th}$) receiver 130a6.

Figure 9:
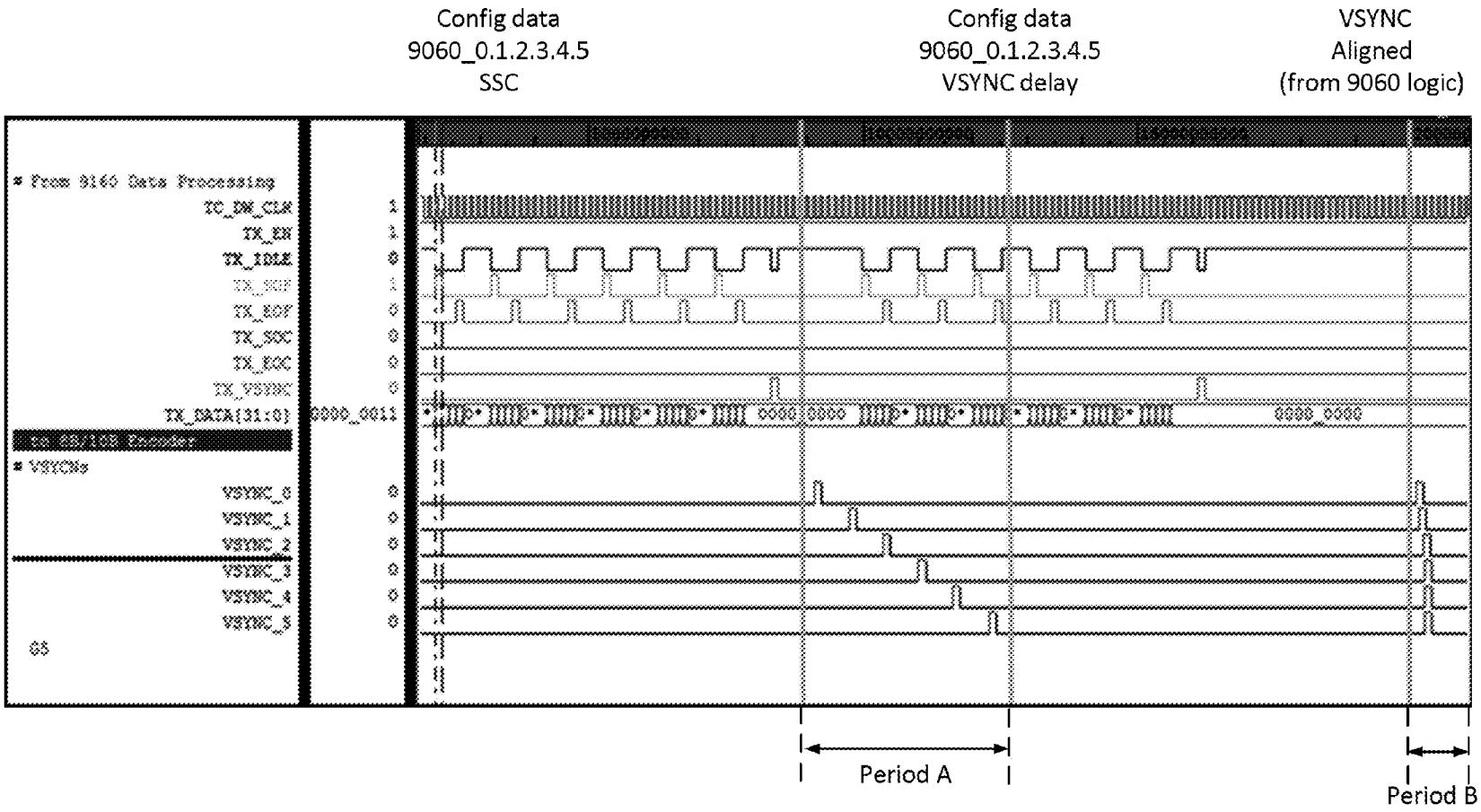
FIG. 9 is a graph showing a configuration data modulation and a synchronization thereof.

FIG. 9 is a graph showing a configuration data modulation and a synchronization thereof. Referring to FIG. 9, six different signals are depicted with latencies in Period A. Each of signals comes with a delay value respectively, which is calculated in a manner as described in FIG. 8. Each of signals is delayed for a period of the delay time based on the relative delay value. Period B in FIG. 9 depicts synchronized six signals at the synchronization time after the period of the delay time.

Figure 10:
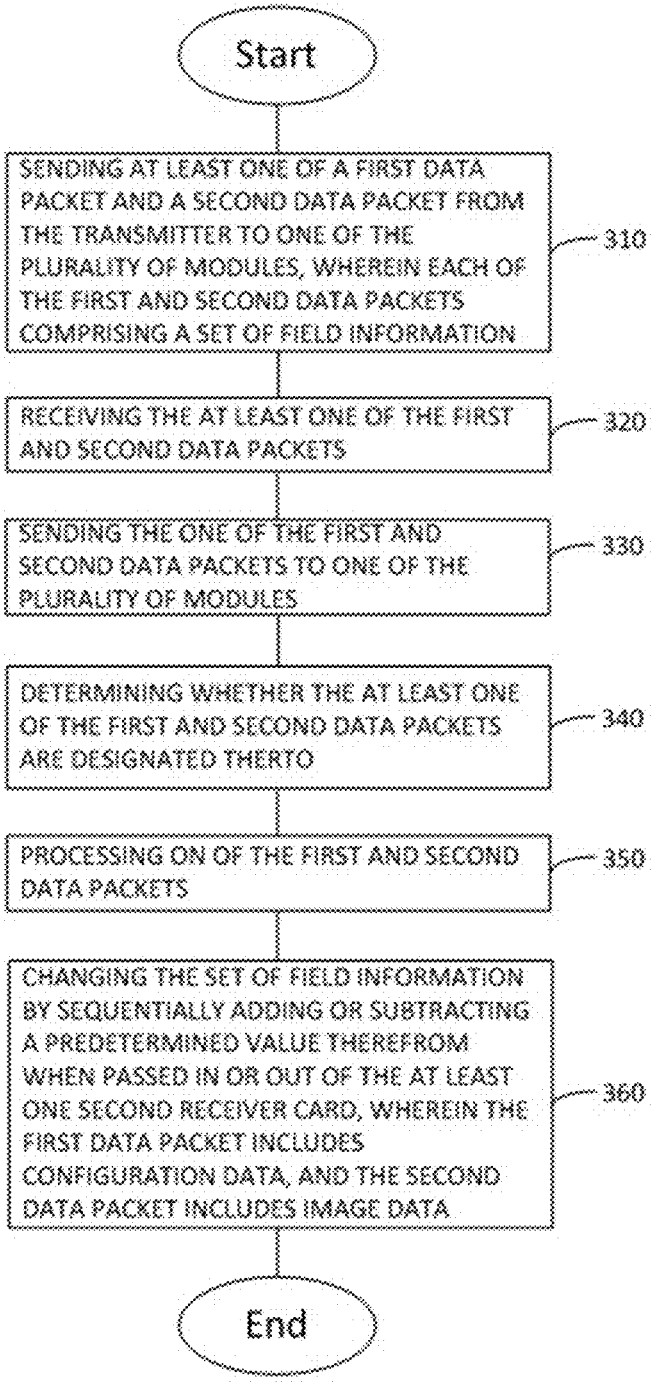
FIG. 10 is a flowchart illustrating a method of transmitting data packet.

FIG. 10 is a schematic flowchart of the method for transmitting data packet using an LED display device that includes transmitter 110, at least one first receiver 120, a plurality of second receiver modules.

Step 310 refers to a step of sending at least one of a configuration data packet and an image data packet from the transmitter 110 to one of the plurality of second receiver modules. Each of the configuration and image data packets includes a set of field information. Step 320 refers to a step of receiving the at least one of the configuration and image data packets. Step 330 refers to a step of sending the one of the configuration and image data packets to one of the plurality of modules. Step 340 refers to a step of determining whether the at least one of the configuration and image data packets are designated thereto. Step 350 refers to a step of processing one of the configuration and image data packets. Step 360 refers to a step of changing the set of field information by sequentially adding or subtracting a predetermined value therefrom when passed in or out of the at least one second receiver. The configuration data packet includes configuration data, and the image data packet includes image data.

It is to be understood that the exemplary embodiments described herein are that for presently preferred embodiments and thus should be considered in a descriptive sense only and not for purposes of limitation. Descriptions of features or aspects within each embodiment should typically be considered as available for other similar features or aspects in other embodiments.

What is claimed is:

1. A display device, comprising:

a transmitter transmitting at least one of a configuration data packet and an image data packet, each of the configuration data packet and the image data packet comprising a set of field information;

a plurality of first receivers coupled to the transmitter;

a plurality of second receiver modules, each comprising a plurality of second receivers, wherein each of the second receiver modules is coupled to at least one of the first receivers, wherein at least one of the first receivers communicates with at least one of the second receivers via a Low Voltage Differential Signaling (LVDS) connection, wherein each of the second receivers comprises at least one processor, and at least one memory, and wherein each of the second receivers reads the set of field information and determines whether the configuration data packet or the image data packet is designated thereto; and a plurality of LED driver groups, each of the LED driver groups coupled to at least one of the second receivers and comprising a plurality of LED drivers, wherein each of the LED driver groups receives at least one of the configuration data packet and the image data packet from at least one of the second receivers.

2. The display device in claim 1, wherein the set of field information is configured to be changed sequentially by adding or subtracting a predetermined value therefrom when passed in or out of each of the second receivers.

3. The display device in claim 2, wherein the configuration data packet further includes a delay time which reflects a value of the set of field information so that at least one of the second receivers transmits the configuration data packet and the image data packet to the LED drivers after a period of the delay time.

4. The display device in claim 3, wherein the second receivers in one of the plurality of second modules are serially arranged, wherein the set of field information further comprises a first field information and a second field information, wherein the first field information has a first number subtracted one from a total number of the serially arranged second receivers, and wherein the second field information has a second number that is a sequential order number of a designated second receiver.

5. The display device in claim 4, wherein each one of the second receivers compares the first field information with the second field information in the image data packet or the configuration data packet and determines whether the image data packet or the configuration data packet is designated thereto.

6. The display device in claim 4, wherein the set of field information includes a synchronization number, and wherein when one of the second receivers recognizes the synchronization number, the one of the second receivers calculates the delay time in proportion with a value of the set of field information such that the one of the second receivers transmits the configuration data packet and the image data packet to the LED drivers after the delay time.

7. The display device in claim 3, wherein the second receivers in one of the plurality of modules are serially arranged, wherein the set of field information further comprises a first field information and a second field information, wherein the first field information includes a first value and the second field information includes a second value, wherein each of the second receivers is configured to compare the first value to the second field value, and when the first number and the second number are the same, the second receiver receives the data packet, and then the first number is increased by an increment of a value one (1) and the set of field information is transmitted to an adjacent second receiver, and wherein the second field information has a second number and the second number a sequential order number of a designated second receiver.

8. The display device in claim 3, wherein at least one of the second receivers stores the configuration data packet and the image data packet when the configuration data packet and the image data packet are designated thereto.

9. The display device in claim 1, wherein each of the first receivers comprises an input port connected to the transmitter via a CAT5/CAT6 cable.

10. The display device in claim 1, wherein the transmitter comprises a gigabit port input and a LVDS port with Clock Date Recovery (CDR) output.

11. The display device in claim 1, wherein the display device further comprises a display main board and a display panel, wherein the transmitter, the plurality of first receivers, and the plurality of second receiver modules are disposed on the display main board, and wherein the plurality of LED driver groups are disposed on the display panel.

12. The display device in claim 1, wherein the at least one memory has a plural number of second memories, and each of the second memories is coupled to the at least one processor.

13. The display device in claim 12, wherein the second memories are static random access memories (SRAMs).

14. The display device in claim 1, wherein each of the configuration data packet or the image data packet comprising, comprises:

a first segment including the set of field information, a second segment including a data information, and a third segment including the set of field information, wherein the first, second, and third segments are sequentially arranged, and wherein the data information of the configuration data packet includes a configuration data, and the data information of the image data packet includes an image data.

15. The display device in claim 14, wherein the first segment further comprises a start of frame and a data mode information, and the third segment further comprises an end of frame and the data mode information, and wherein the data mode information indicates whether the data information includes the configuration data or the image data.

16. A method for transmitting data packet using a display device that comprises a transmitter, a plurality of first receivers coupled to the transmitter, a plurality of second receiver modules, each comprising a plurality of second receivers, where each of the second receiver modules is coupled to at least one of the first receivers, wherein at least one of the first receivers communicates with at least one of the second receivers via a Low Voltage Differential Signaling (LVDS) connection, the method comprising: sending at least one of a configuration data packet and an image data packet from the transmitter to one of the plurality of first receivers, wherein each of the configuration data packet and the image data packet comprises a set of field information; sending at least one of the configuration data packet and the image data packet from one of the plurality of first receivers to at least one of the plurality of second receiver modules, wherein at least one of the first receivers communicates with at least one of the second receivers via the Low Voltage Differential Signaling (LVDS) connection; determining whether the at least one of the configuration data packet and image data packet is designated to the second receiver that receives the at least one of the configuration data packet and the image data packet; processing one of the configuration data packet and the image data packet; and changing the set of field information by sequentially adding or subtracting a predetermined value therefrom when passed in or out of at least one of the second receivers.

17. The method for transmitting data packet in claim 16, wherein the second receivers in one of the plurality of second receiver modules are serially arranged, wherein the set of field information further comprises a first field information and a second field information, wherein the first field information has a first number subtracted one from a total number of the serially arranged second receivers, and wherein the second field information has a second number that is a sequential order number of the designated second receiver in the serially arranged second receivers.

18. The method for transmitting data packet in claim 16, wherein the second receivers in one of the plurality of second receiver modules are serially arranged, wherein the set of field information further comprises a first field information and a second field information, wherein the first field information includes a first value, and the second field information includes a second value, wherein each of the second receivers is configured to compare the first value to the second value, and when the first number and the second number are the same, the second receiver receives the data packet, and then the first number is increased by an increment of a value one (1) and the set of field information is transmitted to an adjacent second receiver, and wherein the second field information has a second number which is a sequential order number of a designated second receiver.

19. The method for transmitting data packet in claim 16, wherein the set of field information further comprises a first field information and a second field information, wherein the method further comprises, comparing the first field information with the second field information and determines whether the configuration data packet and the image data packet are designated thereto.

20. The method for transmitting data packet in claim 19, wherein the second field information includes a synchronization number, and wherein the method further comprises, reading the synchronization number in the second field information, calculating a delay time in proportion with the first field information, and transmitting the at least one of the configuration data packet and the image data packet to the LED drivers after the delay time.

21. The method for transmitting data packet in claim 16, wherein the method for transmitting data packet further comprises communicating the transmitter with at least one of the first receivers via a LVDS port with Clock Date Recovery (CDR) output or a CAT5/CAT6 cable.

22. A light-emitting diode (LED) system comprising:

a transmitter transmitting at least one of a configuration data packet and an image data packet;

each of the configuration and image data packets comprising, a first segment including a set of field information, a start of frame, and a data mode information;

a second segment including data information, and a third segment including the set of field information, an end of frame, and the data mode information, wherein the first, second, and third segments are sequentially arranged;

a plurality of first receivers coupled to the transmitter;

a plurality of second receiver modules, each comprising a plurality of second receivers, wherein each of the second receiver modules coupled to at least one of the first receivers, wherein at least one of the first receivers communicates with at least one of the second receivers via a Low Voltage Differential Signaling (LVDS) connection, each of the second receivers comprising, at least one processor, and at least one memory, wherein each of the second receivers recognizes the set of field information so as to determine whether the set of field information is designated thereto; and a plurality of LED driver groups, each comprising a plurality of LED drivers, wherein each of the LED driver groups coupled to at least one of the second receivers, each of the LED driver groups receiving at least one of the configuration and image data packets from the at least one of the second receivers, wherein the set of field information includes information of a designated second receiver in the plurality of the second receivers, and wherein the configuration data packet includes configuration data, and the image data packet includes image data, wherein the set of field information of at least one of the configuration and image data packets is configured to be changed sequentially adding or subtracting a predetermined value therefrom when passed in or out of each of the second receivers, wherein the configuration data packet further includes a delay time which reflects the change of the set of field information so that the at least one of the second receivers transmits at least one of the configuration and image data packets to the plurality of LED drivers after a period of the delay time, wherein the second receivers are serially arranged in one of the plurality of modules.

23. A method for transmitting data packet using a display device that comprises a transmitter, a plurality of first receivers coupled to the transmitter, a plurality of second receiver modules, each comprising a plurality of second receives, wherein each of the second receiver modules is coupled to at least one of the first receivers, the method comprising: sending at least one of a configuration data packet and an image data packet from the transmitter to one of the plurality of first receivers, wherein each of the configuration data packet and the image data packet comprises a set of field information, wherein the set of field information further comprises a first field information and a second field information, wherein the first field information includes a first number, and the second field information includes a second number, wherein the second number is a sequential order number of a designated second receiver; sending the at least one of the configuration data packet and the image data packet from one of the plurality of first receivers to at least one of the plurality of second receiver modules, wherein the second receivers in one of the plurality of second receiver modules are serially arranged; configuring each of the second receivers to compare the first number to the second number to determine whether the at least one of the configuration data packet and the image data packet is designated to the second receiver that receives the at least one of the configuration data packet and the image data packet; receiving the at least one of the configuration data packet and the image data packet in the second receiver when the first number and the second number are the same, and processing the at least one of the configuration data packet and the image data packet; changing the first number of the first field information sequentially by adding or subtracting a predetermined value when passed in or out of at least one of the second receivers; and transmitting the at least one of the configuration data packet and the image data packet comprising the set of field information to an adjacent second receiver.

* * * * *